United States Patent [19]

Liebl

[11] Patent Number: 4,983,845

[45] Date of Patent: Jan. 8, 1991

[54] APPARATUS OPERATING WITH CONTACT IONIZATION FOR THE PRODUCTION OF A BEAM OF ACCELERATED IONS

[75] Inventor: Helmuth Liebl, Eching, Fed. Rep. of Germany

[73] Assignee: Max-Planck-Gesellschaft zur Foerderung der Wissenschaften v.V., Fed. Rep. of Germany

[21] Appl. No.: 519,268

[22] Filed: May 2, 1990

Related U.S. Application Data

[63] Continuation of Ser. No. 265,056, Oct. 31, 1988, abandoned.

[30] Foreign Application Priority Data

Nov. 19, 1987 [DE] Fed. Rep. of Germany ..... 3739253

[51] Int. Cl.[5] ..... H01J 27/00

[52] U.S. Cl. ..... 250/423 R; 313/362.1; 313/231.31; 315/111.81

[58] Field of Search ..... 250/423 R, 423 P, 424, 250/425, 426, 427; 313/362.1, 359.1, 231.31, 231.41; 315/111.81

[56] References Cited

U.S. PATENT DOCUMENTS

| | | | |
|---|---|---|---|
| 4,318,028 | 3/1982 | Perel et al. | 313/362.1 |
| 4,475,063 | 10/1984 | Aston | 250/426 |
| 4,595,835 | 6/1986 | Boulin et al. | 250/423 R |
| 4,631,448 | 12/1986 | Tamura et al. | 315/111.81 |
| 4,687,938 | 8/1987 | Tamura et al. | 315/111.81 |
| 4,730,111 | 3/1988 | Vestal et al. | 250/423 R |
| 4,774,433 | 9/1988 | Ikebe et al. | 250/423 R |

FOREIGN PATENT DOCUMENTS

| | | |
|---|---|---|
| 161744 | 11/1985 | European Pat. Off. . |
| 1248820 | 8/1967 | Fed. Rep. of Germany . |
| 2019926 | 11/1970 | Fed. Rep. of Germany . |
| 2805273 | 6/1981 | Fed. Rep. of Germany . |
| 982671 | 2/1965 | United Kingdom . |
| 1383128 | 2/1975 | United Kingdom . |

OTHER PUBLICATIONS

J. F. Mahoney, J. Appl. Phys. vol. 40, #13, (1969), pp. 5101–5106.

Abstract of JP-OS 61-179033 (A), E468 of Jan. 7, 1987, vol. 11.

Abstract of JP-OS 59-44751 (A), E252 of Jun. 22, 1984, vol. 8.

R. G. Wilson et al, "Ion Beams" 1973, pp. 26 to 41, 72 to 77 and 99 to 101.

T. Noda, Intern J. of Mass Spectrometry and Ion Physics, vol. 46, (1983), pp. 15–18.

J. Ishikawa et al, Nuclear Instruments and Methods in Physics Res., vol. 21 (1987), pp. 186–189.

*Primary Examiner*—Bruce C. Anderson

*Attorney, Agent, or Firm*—Handal & Morofsky

[57] ABSTRACT

An apparatus operating by contact ionization for the production of a beam of accelerated ions comprises an ionization electrode (1) in the form of a small tube, which forms a duct, the inside of which is used for contact ionization of the atoms for ionization, and which has capillary dimensions at least adjacent its exit, which is situated opposite an acceleration electrode (3).

19 Claims, 1 Drawing Sheet

APPARATUS OPERATING WITH CONTACT IONIZATION FOR THE PRODUCTION OF A BEAM OF ACCELERATED IONS

This application is a continuation, of application Ser. No. 265,056, filed Oct. 31, 1988.

The invention relates to apparatus for the production of a beam of accelerated ions by contact ionization of appropriate particles, such as atoms, on a heated surface of an ionization electrode and for acceleration of the ions produced on the contact ionization surface, acceleration taking place in an acceleration zone between the ionization electrode and an acceleration electrode.

BACKGROUND OF THE INVENTION

Apparatus of this kind, which may briefly be referred to as "thermal surface ion sources" or "contact ionization sources" is described, for example, in the book by R. G. Wilson and G. R. Brewer "Ion Beams", New York 1973, more particularly pages 26 to 36 and pages 72 to 77. Such apparatus is based on the effect that when neutral atoms impinge upon a surface hot enough for the atoms not to be adsorbed on the surface some of the atoms are ionized on leaving the surface. Saha-Langmuir's law applies to the degree of ionization R, i.e. the ratio of the ions to the total number of particles leaving the surface, the degree of ionization $R_+$ for positive ions being:

$$R_+ = n_+/(n_0+n_+) = (1+K_+\exp(I-W)/kT))^{-1} \quad (1)$$

and the degree of ionization $R_{31}$ for negative ions being:

$$R_- = n_-/(n_0+n_-) = (1+K_-\exp((W-E)/kT))^{-1} \quad (2)$$

where $n_+$ = number of positive ions leaving the surface $n_-$ = number of negative ions leaving the surface $n_0$ number of neutral atoms leaving the surface W = electron work function of the surface I = ionization potential of atoms E = electron affinity of atoms T = surface temperature k = Boltzmann's constant $K_+$ and $K_-$ = statistical factors for positive and negative ions respectively (for alkaline metals $K_+=2$, for halogens $K_+=4$).

If $W-I>0.4$ eV and $E-W>0.4$ eV, then $R_+$ and $R_-$ have almost the same value 1, i.e. practically all the atoms impinging on the surface vaporize as positive and negative ions. For example, cesium vapour (I=3.88 eV) on impinging on a hot (1300K) tungsten surface (W=4.54 eV) is practically completely positively ionized while on the other hand, for example, iodine vapour (E=3.23 eV) impinging on a hot lanthanum hexaboride surface (W=2.70 eV) is practically completely negatively ionized. Similar high degrees of ionization can be obtained for the other alkali metals and halogens and for a number of other atoms.

It is known either to pass the particles for ionization in vapour form from the front on to the hot surface of the ionization electrode of suitable material or diffuse it from the rear through a hot frit of the appropriate material to the then porous surface. The resulting ions are then sucked away from the surface by an electric field produced between the surface and an acceleration electrode disposed at a distance in front of the same. The attainable current densities J are limited in the above cases by Child's space charge law which, for a planar arrangement is as follows:

$$J = 5{,}45\times10^{-8}V^{1,5}/\sqrt{M}\,d^2A\ cm^{-2} \quad (3)$$

where

V = acceleration voltage

M = mass number d = distance between ionizing surface and the acceleration or extraction electrode.

In an apparatus known from DE-PS No. 28 05 273 C3 for the production of a beam of accelerated ions by contact ionization, the space charge limitation of the emission current density is shifted to much higher values than in the case of planar electrodes by giving the ionizing surface a highly convex curvature so that a very high electrical field strength prevails thereon. The emission current density is then limited by the vapour pressure of the element for ionization prevailing between the electrodes. This vapour pressure must be sufficiently low so that no electrical breakdown occurs due to impact ionization in the vapour.

SUMMARY OF THE INVENTION

The embodiment to be described below gets round this limitation by the fact that the vapour for ionization is not passed into the space between the acceleration electrode and the highly convex hot ionizing surface of the ionization electrode; instead the latter has a duct preferably in the form of a capillary, such as a bore, and the atoms for ionization are passed in gas or vapour form from the rear from a reservoir, oven or any other suitable source through this duct which, in comparison with the pores of a frit, is macroscopic. On the way through the heated bore or capillary the atoms are ionized on the inner wall and on emerging from the duct exit are immediately engaged and accelerated by the strong electrical field prevailing at the tip of the ionization electrode. The vapour pressure prevailing in the acceleration zone is governed by the small proportion of non-ionized vapour from the capillary and atoms which had impacted the acceleration electrode in the form of ions and are re-sputtered by the subsequent ions. Given the same emission current density as with the above known apparatus of this kind the vapour pressure is much lower or, alternatively, given an appropriate increase in the vapour throughout it is possible to achieve a much higher emission current density than in the known case before any electrical breakdown occurs.

The invention is explained in detail hereinafter with reference to the drawing wherein.

DETAILED DESCRIPTION OF PREFERRED EMBODIMENT

Figure 1:
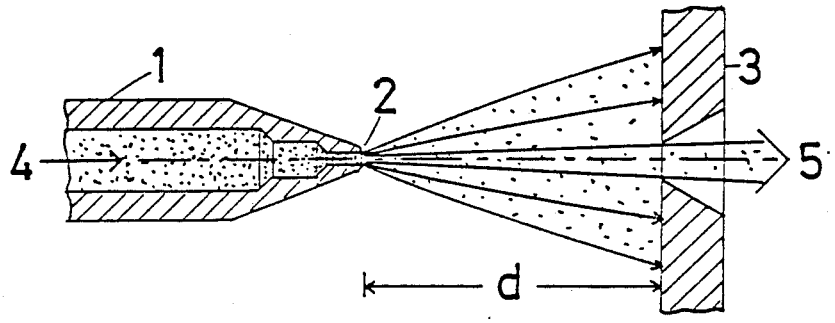
FIG. 1 is a detail.

The apparatus shown in the drawing for the production of a beam of accelerated cesium ions comprises an ionization electrode 1 in the form of a thin elongate tube, made from a material having a high electron work function, e.g. tantalum, and an acceleration electrode 3 in the form of an annular disc disposed at a distance d in front of the front end of the ionization electrode 1. The front end of the ionization electrode 1 tapers in the direction of the acceleration electrode 3 and forms an approximately domeshaped tip 2 having a capillary bore, the tip diameter being small in comparison with the distance d from the acceleration electrode 3. The inside diameter of the tubular ionization electrode 1 tapers stepwise towards the tip, as will be seen from FIG. 1.

The front end of the tubular ionization electrode 1 is surrounded by an annular thermionic cathode 6, which is in turn surrounded by a sheet-metal cylinder 7 which acts as a heat shield. That end of the tubular ionization electrode 1 which is remote from the acceleration electrode 3 leads into a reservoir 8 which is partially filled with cesium metal 9 and has a heating jacket 10 by means of which the reservoir 8 can be heated so that the cesium vapour pressure can be brought to a required value.

Typical dimensions are:

Tip diameter=0.4 mm

Capillary diameter=0.1 mm

Distance d=5 mm

In operation the front end of the ionization electrode 1 is heated to the required temperature of about 1300K by electron impact. For this purpose, electrons are emitted from the filament of the thermionic cathode 6, said filament forming an annular surround for the capillary, and are accelerated radially towards the ionization electrode by some kilovolts. Cesium vapour 4 is fed from the heated reservoir 8 through the tubular ionization electrode 1 and in these conditions the cesium vapour is ionized by impacts on the hot inner wall of the ionization electrode and, in particular, the front capillary part. There is a voltage of some kilovolts between the ionization electrode 1 and the acceleration electrode 3, the polarity of this voltage being such that the $Cs^+$ ions emerging from the capillary are accelerated towards the acceleration electrode 3. A $Cs^+$ ion beam 5 of some keV energy then emerges through a central opening in the acceleration electrode 3.

Figure 2:
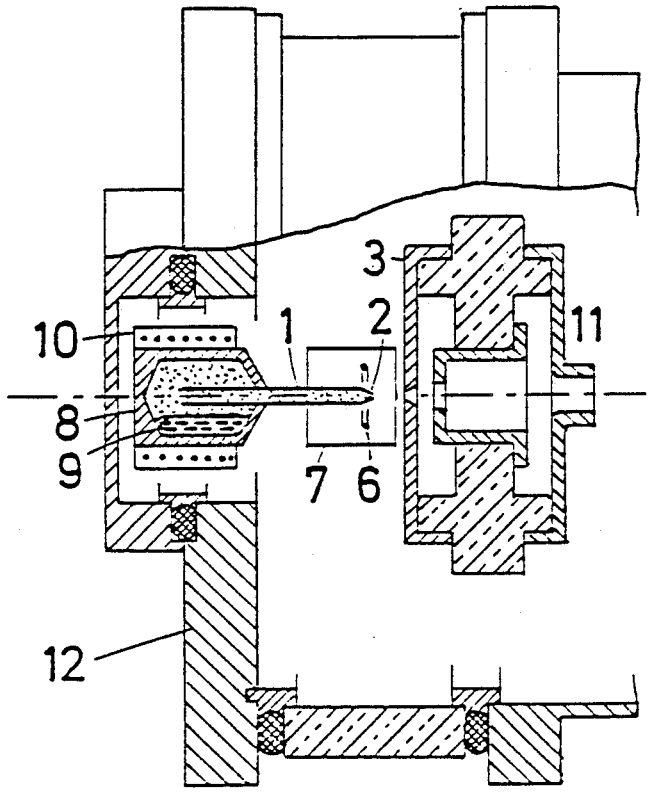
FIG. 2 is a simplified sectional view of a preferred embodiment of the present invention for the production of a beam of positive cesium ions.

The ion beam can be focused by an electrostatic lens 11 (FIG. 2), the front electrode of which is formed by the acceleration electrode 3. The complete system is disposed in a vacuum container 12 shown only partially in FIG. 2. For the sake of clarity FIG. 2 omits the electrode mountings and electrical bushings, which can be of conventional construction.

The contact ionization surface can also be formed by a layer of a suitable material covering at least part of the inner wall of the tubular duct, more particularly the capillary part on the exit side.

The invention can also be used for the production of ions of elements other than cesium, more particularly of other alkali metals. Beams of negative ions, more particularly halogen ions, can also be produced if the ionization electrode or at least the inner wall of the capillary is made from a material of high electron affinity, e.g. lanthanum hexaboride. Of course other heating devices, and other devices delivering the atoms for ionization, can also be used.

I claim:

1. An apparatus operating by contact ionization for the production of a beam of accelerated ions comprising a source of atoms for ionization, an ionization electrode having a tubular contact ionization surface for contact ionization of the atoms, a heating device for heating the ionization electrode and an acceleration electrode spaced from the ionization electrode to accelerate the atoms ionized on the contact ionization surface, the ionization electrode forming a tubular duct which leads from the source of atoms for ionization to an exit at a tip projecting toward the acceleration electrode which produces a predetermined field strength at said tip, said tip having a given diameter, and the inner wall of said tubular duct forming said tubular contact ionization surface, said tip being spaced by a predetermined distance from said acceleration electrode, and said tip diameter being substantially smaller than said predetermined distance from said acceleration electrode to result in an emission current density substantially independent of space charge effects.

2. Apparatus as claimed in claim 1, in which the duct has capillary dimensions at least at the part adjacent the exit.

3. Apparatus as claimed in claim 2, in which the duct has a diameter of the order of 0.1 mm adjacent to its tip.

4. Apparatus as claimed in claim 1, in which the contact ionization electrode is bar or rod shaped at least at its end adjacent to the exit and tapers towards its tip.

5. Apparatus as claimed in claim 4, in which at the duct exit the tip has a diameter of the order of 0.4 mm.

6. Apparatus as claimed in claim 1, in which the diameter of the duct decreases stepwise from the source in the direction of the tip.

7. Apparatus as claimed in claim 1, in which the heating device comprises an electron source surrounding the ionization electrode in the area of its tip.

8. Apparatus as claimed in claim 7, in which the electron source is a thermionic cathode and is surrounded by a tubular heat shield.

9. Apparatus as claimed in claim 1, in which the acceleration electrode forms part of an electostatic lens.

10. Apparatus as claimed in claim 1, in which the source of atoms for ionization comprises a reservoir and a separate heater for the reservoir.

11. Apparatus as claimed in claim 1, wherein said heating device is disposed around said ionization electrode adjacent said tip of said ionization electrode.

12. Apparatus as claimed in claim 1, wherein said tip is dome-shaped.

13. An apparatus operating by contact ionization for the production of a beam of accelerated ions, comprising a source of atoms in vapor form for ionization, an ionization electrode having a tubular contact ionization surface for contact ionization of the atoms, a heating device for the ionization electrode and an acceleration electrode spaced from the ionization electrode, said acceleration electrode positioned to create a potential field for accelerating the atoms ionized on the contact ionization surface, the ionization electrode forming a tubular duct which leads from the source of atoms for ionization to an exit at a tip projecting towards the acceleration electrode, said tip having a given diameter, and the inner wall of which forms said tubular contact ionization surface, said tip being spaced by a predetermined distance from said acceleration electrode, forming an acceleration space between said tip and said acceleration electrode, and said tip diameter being small in comparison with said predetermined distance from said acceleration electrode to to obtain an emission current density limited by vapor pressure of said atoms in vapor form in said acceleration space and substantially independent of space charge effects.

14. Apparatus as claimed in claim 13 wherein the ion source material of atoms has an ionization potential less than the electron work function of said ionization electrode surface.

15. Apparatus as claimed in claim 13, wherein the ion source material of atoms has an electron affinity greater than the electron work function of said ionization electrode surface.

16. Apparatus as claimed in claim 13, wherein said source atoms with respect to which high ionization conversion of source atoms is obtained, are alkali metals.

17. Apparatus as claimed in claim 13, wherein said source atoms, with respect to which high ionization conversion of source atoms is obtained, are halogens.

18. Apparatus as claimed in claim 13, wherein the number of ionized atoms greatly outnumbers the number of non-ionized atoms at said exit at said tip.

19. An apparatus operating by contact ionization for the production of a beam of accelerated ions comprising a source of atoms for ionization, an ionization electrode having a non-porous surface for contact ionization of the atoms, a heating device disposed around the ionization electrode and an annular disc acceleration electrode adjacent to, and spaced from the ionization electrode to accelerate the atoms ionized on the contact ionization surface, the ionization electrode forming a tubular duct which leads from the source of atoms for ionization to an exit at a dome-shaped tip situated opposite the acceleration electrode beyond which a focusing means is located, said tip having a given diameter, and the inner wall of said ionization electrode forming said non-porous contact ionization surface, said tip being spaced by a predetermined distance from said acceleration electrode, forming an acceleration space between said tip and said acceleration electron, the ratio of said predetermined distance to said tip diameter being sufficient for an emission current density limited by vapor pressure of said atoms in vapor form in said acceleration space substantially independent of space charge effects, when an adequate potential difference across said acceleration space is created.

* * * * *